US012129736B2

(12) United States Patent
Rusten et al.

(10) Patent No.: US 12,129,736 B2
(45) Date of Patent: Oct. 29, 2024

(54) METHOD FOR PROVIDING A PERMANENT BARRIER IN A WELL

(71) Applicant: Interwell P&A AS, Hafrsfjord (NO)

(72) Inventors: Torgeir Rusten, Vikhammer (NO); Stian Tøndel, Trondheim (NO)

(73) Assignee: Interwell P&A AS, Hafrsfjord (NO)

( * ) Notice: Subject to any disclaimer, the term of this patent is extended or adjusted under 35 U.S.C. 154(b) by 0 days.

(21) Appl. No.: 18/276,931

(22) PCT Filed: Mar. 10, 2022

(86) PCT No.: PCT/EP2022/056116
§ 371 (c)(1),
(2) Date: Aug. 11, 2023

(87) PCT Pub. No.: WO2022/194655
PCT Pub. Date: Sep. 22, 2022

(65) Prior Publication Data

US 2024/0117703 A1 Apr. 11, 2024

(30) Foreign Application Priority Data

Mar. 19, 2021 (NO) ..... 20210354

(51) Int. Cl.
*E21B 33/13* (2006.01)
*E21B 36/00* (2006.01)

(52) U.S. Cl.
CPC ..... *E21B 33/13* (2013.01); *E21B 36/008* (2013.01)

(58) Field of Classification Search
CPC ..... E21B 33/13; E21B 36/008
See application file for complete search history.

(56) References Cited

U.S. PATENT DOCUMENTS 8,151,895 B1 * 4/2012 Kunz ..... E21B 29/10 166/387
9,010,425 B2 * 4/2015 Larsen ..... E21B 43/116 166/285

(Continued)

FOREIGN PATENT DOCUMENTS

EP 3 196 402 7/2017
WO 2013/135583 9/2013

(Continued)

OTHER PUBLICATIONS

International Search Report and Written Opinion of the International Searching Authority issued Jul. 28, 2022 in International (PCT) Application No. PCT/EP2022/056116.

(Continued)

*Primary Examiner* — Silvana C Runyan
(74) *Attorney, Agent, or Firm* — Wenderoth, Lind & Ponack, L.L.P.

(57) ABSTRACT

A method for providing a permanent barrier in a well includes lowering a first, particulate constituent of a pyrotechnic mixture to a desired location in the well, wherein the first constituent is a metal oxide. The method further includes waiting a first predetermined period of time to allow the first, particulate constituent to settle as sediment at the desired location, lowering a second constituent of the pyrotechnic mixture to the desired location in the well, wherein the second constituent is a metal, and igniting the pyrotechnic mixture to start a heat generating exothermic reduction-oxidation process.

11 Claims, 8 Drawing Sheets

(56) References Cited

U.S. PATENT DOCUMENTS

| | | | | |
|---|---|---|---|---|
| 9,228,412 | B2 * | 1/2016 | Lowry | E21B 33/134 |
| 10,883,329 | B2 | 1/2021 | Tøndel et al. | |
| 2004/0194957 | A1 | 10/2004 | Jabs | |
| 2006/0014459 | A1 | 1/2006 | Snijder et al. | |
| 2018/0094504 | A1 * | 4/2018 | Hearn | E21B 33/13 |
| 2019/0186233 | A1 | 6/2019 | Shafer et al. | |

FOREIGN PATENT DOCUMENTS

| | | |
|---|---|---|
| WO | 2015/116261 | 8/2015 |
| WO | 2020/123918 | 6/2020 |

OTHER PUBLICATIONS

Search Report issued Oct. 15, 2021 in Norwegian Application No. 20210354.

* cited by examiner

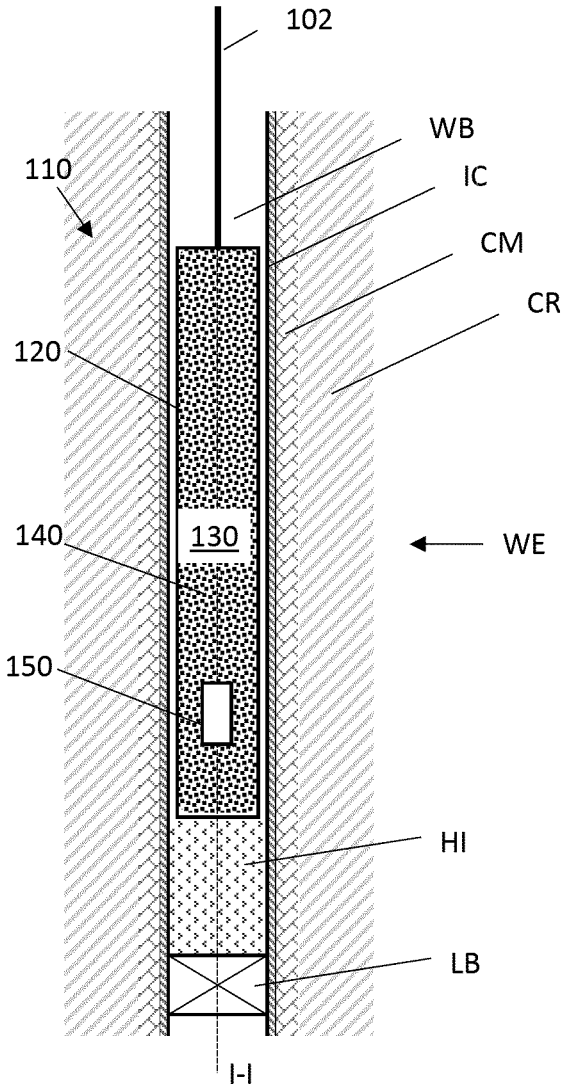
Fig. 1a: Prior art
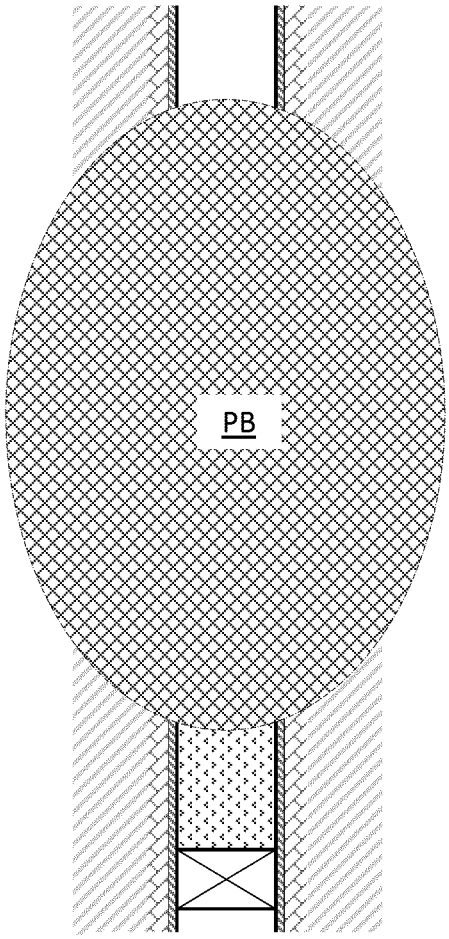
Fig. 1b: Prior art

I-I

I-I

METHOD FOR PROVIDING A PERMANENT BARRIER IN A WELL

FIELD OF THE INVENTION

The present invention relates to a method for providing a permanent barrier in a well. The present invention also relates to a method of constructing a well. The present invention also relates to a method of permanently abandoning a such a well.

BACKGROUND OF THE INVENTION

Plugging and abandonment operations, often referred to as P&A operations, are performed to permanently close oil and/or gas wells. Typically, this is performed by providing a permanent well barrier above the oil and/or gas producing rock types, typically in the cap rock in which the well has been drilled through.

There are several technical and regulatory requirements for such permanent well barriers, some of which are a) impermeability of oil and/or gas through the permanent well barrier, b) long term integrity, c) non shrinking of the permanent well barrier, d) ductility (non brittle)—the permanent well barrier must be able to withstand mechanical loads or impact, e) resistance to different chemicals/substances (H2S, C02 and hydrocarbons) and f) wetting—to ensure bonding to steel.

WO 2015/116261 describes that wells are sealed by means of thermite reaction charges inserted into the wells. The reaction charge can be diluted by addition of metal oxides, silica, or the like control reaction pressure, peak temperature, reaction rate, and expansion characteristics of the resulting thermite plug. The use of dilution of the thermite reactants can take the form of a thermite charge with specific layers, including relatively high and low reaction temperature layers. The ignition source can be oriented to achieve directional control on the product expansion including radial or axial expansion. The charge can be loaded with a large mass to compress the resulting thermite plug into the borehole wall and reduce its porosity during the reaction process. A further variation involves continuous feed of the thermite reactants to the reaction zone. Various combinations and permutations of the above inventive concepts are described.

US 2018/0094504 describes composition for a plug for wellbores undergoing plugging and abandonment operations.

EP 3196402 describes a to-be-abandoned underground wellbore is plugged along any desired longitudinal interval and radial extent by: —dropping capsules filled with a grout, pyrotechnic, swelling, bismuth, clay, bentonite, hardening, sintering, and/or other plug generating material into the wellbore at selected time intervals; —inducing the capsules to accumulate above a downhole cement or other barrier in the wellbore; —inducing the accumulated capsules to disintegrate and to release the plug generating material into the wellbore; and —inducing the released plug generating material to generate a fluid tight barrier of a desired length and radial extent within the wellbore.

WO 2020/123918 describes a method is provided for plugging a wellbore having a casing and cement surrounding the casing and traversing a formation, which involves configuring and using at least one tool located in the wellbore to deliver composite material to a target area in the wellbore, wherein the composite material includes metal alloy and an exothermal reactant. The at least one tool is further configured and used to apply heat or spark to the composite material in the target area to ignite the exothermal reactant of the composite material and melt the metal alloy of the composite material. The melted metal alloy of the composite material is permitted to solidify to form a plug at the target area in the wellbore.

US 2006/0144591 describes a method and apparatus for creating a fluid seal in a subterranean well structure having a fluid seal defect. The method comprises introducing a meltable repair material proximate a structure in a subterranean well which has a fluid seal defect or enhanced seal capacity is required or it is desired to temporarily or permanently hydraulically isolate a portion the well or strengthen the structural integrity of well tubulars or tubular hangers. Exothermic reactant materials are located proximate the meltable repair material. The exothermic reactant material is ignited or an exothermic reaction otherwise initiated which supplies heat to and melts the meltable repair material into a molten mass. The molten mass flows and solidifies across the structure and the fluid seal defect to effect a fluid seal in the subterranean well structure or the structural integrity is enhanced.

In WO2013/135583 (Interwell P&A AS), it is disclosed a method for performing a P&A operation wherein a first step, it was provided an amount of a heat generating mixture (for example thermite) at a desired location in the well and thereafter to ignite the heat generating mixture to start a heat generation process. It is also disclosed a tool for transporting the heat generating mixture into the well before ignition. Such a heat generating mixture may also be referred to as a pyrotechnic mixture.

In short, the above prior art will be described with reference to FIGS. 1*a* and 1*b*. In FIG. 1, a well WE is shown to be provided through a section of a cap rock CR. The inner surface of a well bore WB is provided by an inner casing IC, where cement CM is provided in the annulus between the inner casing IC and the cap rock CR. It should be noted that some wells have several casings provided radially outside of each other, where cement or fluids are provided in the respective annuli. In FIG. 1*a*, it is shown that a lower barrier LB has been provided in the well bore WB. A well tool 110 has been lowered into the well above the heat insulating material HI by means of a wireline 102. The well tool 110 comprises a housing 120 with a compartment 130 which contains a heat generating mixture 140 (for example thermite). An ignition device 150 is also provided in the compartment 130. The ignition device 150 starts the heat generating process of the heat generating mixture 140. The ignition device 150 may be time actuated or pressure actuated. Alternatively, the ignition device 150 may be actuated by means of a topside signal transferred via wire to the ignition device.

The result after the ignition is shown in FIG. 1*b*. Here it is shown that the elements of the well, i.e. inner casing IC, cement CE and cap rock CR have melted and thereafter hardened into one solid permanent well barrier PB containing constituents of rock, cement, steel and other elements being present in the well. Such other elements are the end product of the heat generation process, remains of the tool used to transport the heat generating mixture into the well, the ignition system etc.

This technology has been tested in test centers and in field trials, in order to verify that the permanent well barrier fulfills technical and regulatory requirements.

One object of the present invention is to provide a more efficient method for providing a permanent barrier in a well.

One object is to provide a method of constructing a well which may be efficiently abandoned when it is desired to permanently abandon the well.

SUMMARY OF THE INVENTION

The present invention relates to a method for providing a permanent barrier in a well, wherein the method comprises the steps of:

a) lowering a first, particulate constituent of a pyrotechnic mixture to a desired location in the well; wherein the first particulate constituent is a metal oxide;

b) waiting a first predetermined period of time to allow the first, particulate constituent to settle as sediment at the desired location;

c) lowering a second constituent of the pyrotechnic mixture to the desired location in the well; wherein the second constituent is a metal;

d) igniting the pyrotechnic mixture to start a heat generating exothermic reduction-oxidation process.

As used herein, the term "particulate" is referring to a material comprising a plurality of smaller particles. The particulate material may be in powder form or in a granule form.

In one aspect, the amounts of metal oxide and the metal are mixed in a stochiometric ratio.

In one aspect, the method is providing a cap-rock to cap-rock permanent barrier extending across the whole cross-section of a wellbore.

In one aspect, the step of lowering the second constituent comprises:

c1) lowering the second constituent as a second, particulate constituent to the desired location in the well;

c2) waiting a second predetermined period of time to allow the second, particulate constituent to settle as sediment.

In one aspect, the method comprises, prior to step a), a step of:

mixing the first constituent and the second constituent before lowering them to the desired location.

Here, the first constituent and the second constituent are allowed to settle as sediment at the desired location simultaneously, i.e. the first and second predetermined periods of time are the same period of time.

In one aspect, the first and second constituents are formed as a core-shell composition with alternating materials in the core and in the shell.

In one aspect, the step of positioning the first and/or second constituent comprises the step of circulating the first and/or second constituent to the desired location in the well.

In one aspect, the steps a) and b) are performed before steps c1) and c2).

Here, the second constituent is allowed to settle as sediment above the first constituent.

In one aspect, the steps a) and b) and the subsequent steps step c1) and c2) are performed alternatingly, allowing a multi-layered sediment to form at the desired location.

In one aspect, the step of lowering the second constituent comprises:

c) lowering the second constituent as one or a plurality of solid objects to the desired location in the well.

In one aspect, steps a) and b) are performed before step or after step c).

In one aspect, the second constituent is a solid object in the form of a spear, a cylinder etc. The second constituent, for example in the form of a spear, may be pushed or forced down into the settled first constituent. The second constituent, for example in the form of a cylinder, may be lowered first. Then, the second constituent may be lowered to fill the annular space radially outside of the cylinder.

In one aspect, the step of lowering the second constituent comprises:

lowering the second constituent of the pyrotechnic mixture into contact with the first constituent at the desired location in the well.

Alternatively, the second constituent may be separated from contact with the first constituent until the step of igniting the pyrotechnic mixture. The second constituent may for example be separated from contact with the first constituent by means of a foil, a sheet etc., which will easily be melted by the heat from the igniter. Alternatively, the second constituent may be separated from contact with the first constituent by means of a separating mechanism, for example a mechanically, electrically or chemically controlled separating mechanism.

In one aspect, the method comprises, prior to step a), a step of:

removing at least parts of a well pipe of the well such as to form communication with an annulus outside of the well pipe, wherein the annulus is forming the desired location.

In one aspect, the method comprises the step of:

lowering a guide to the area in which parts of the well pipe has been removed;

guiding the first constituent and/or second constituent to the desired location by means of the guide.

In one aspect, the first constituent is a particulate matter having a particle size of 0.1 to 5.0 mm.

In the above embodiments in which the second constituent is also a particulate constituent, the second constituent comprises particles having a particle size of 0.1 to 5.0 mm. It should be noted that the second constituent in at least some of the above embodiments may have a particle size above 5.0 mm.

In one aspect, the method further comprise the steps of:

lowering a heating tool into the well to a location adjacent to the desired location;

sintering the first, particulate constituent and/or the second, particulate constituent by means of heat from the heating tool.

In one aspect, the heating tool may be lowered before step a). In one aspect, the heating tool may be lowered before step d). The heating tool is providing that the first, particulate constituent and/or the second, particulate constituent becomes heated to a temperature of ca 600-800° C. It should be noted that this temperature interval is considerably lower than the temperature of ca. 1200° C. needed to initiate the heat generation exothermic reduction-oxidation process.

As used herein, the term "sintering" is defined as the process of compacting and forming a solid mass of material by heat or pressure without melting it to the point of liquefaction. Above, the sintering is performed by exposing the first, particulate constituent and/or the second, particulate constituent to heat from the heating tool.

The sintering process will prevent that the particulate constituent and/or the second, particulate constituent become unintentionally flushed out from the annulus again.

In one aspect, the first, particulate constituent comprises bismuth oxide.

In one aspect, the second constituent comprises aluminum or an aluminum alloy.

The present invention also relates to a method of constructing a well, wherein the method comprises the steps of:

lowering a casing radially inside a formation wall or radially inside of a further casing, thereby forming an annulus radially outside of the casing;

positioning a first constituent of a pyrotechnic mixture in the annulus; wherein the first constituent is a metal oxide;

allowing the first constituent to solidify in the annulus, thereby providing zonal isolation between the casing and the formation wall or between the casing and the further casing.

In one aspect, the step of allowing the first constituent to solidify comprises the step of:

sintering the first constituent.

Alternatively, or in addition, the first constituent may be allowed to solidify by allowing the first constituent to settle as sediment.

In one aspect, the step of positioning the first constituent comprises the step of:

positioning a first constituent of a pyrotechnic mixture in the annulus in the area of the cap-rock of the well.

In one aspect, the step of positioning the first constituent comprises the step of circulating the first constituent to the annulus.

In one aspect, the step of positioning the first constituent comprises the step of positioning the first constituent between layers of cement in the annulus.

In one aspect, the method comprises the steps of:

lowering a second constituent of the pyrotechnic mixture to the area of the solidified first constituent, wherein the second constituent is a metal;

igniting the pyrotechnic mixture to start a heat generating exothermic reduction-oxidation process.

In one aspect, the method comprises, prior to step a), a step of:

setting a lower barrier in the well, wherein an area of the well above the lower barrier is forming the desired location.

DETAILED DESCRIPTION

Embodiments of the present invention will be described in detail below with reference to the enclosed drawings, wherein:

FIGS. 1*a* and 1*b* illustrates a prior art well tool for performing a P&A operation;

EXAMPLE 1

Figure 2:
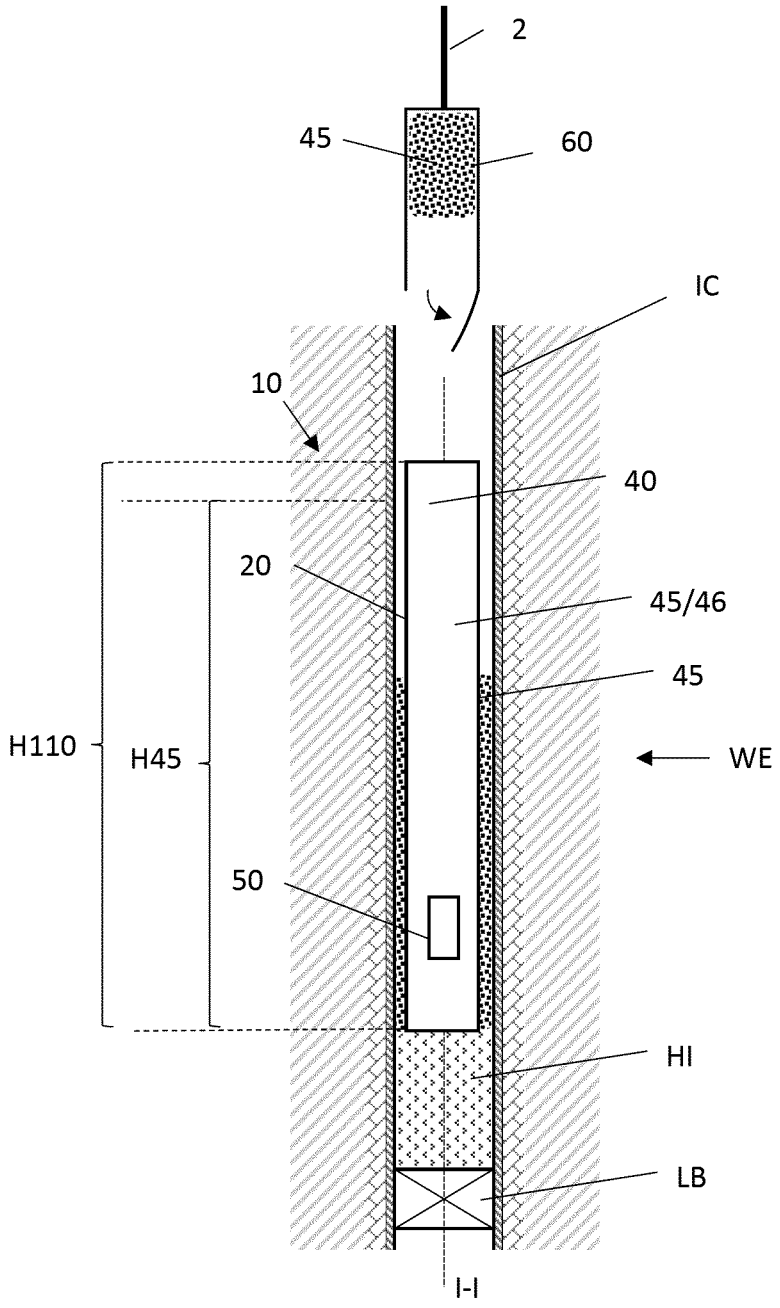
FIG. 2 shows an first embodiment in which at least one constituent of a pyrotechnic mixture is lowered to the space outside of a tool present in the well.

It is now referred to FIG. 2. Here it is shown a well WE comprising an inner casing IC cemented by means of cement CE within the formation, here indicated as a cap rock formation CR. A lower barrier LB has been set in the inner casing IC. Optionally, a heat insulation material HI may be provided above the lower barrier LB.

Then, a well tool device 10 has been lowered into the well above the lower barrier LB by means of a wireline. The well tool device 10 comprises a housing 20 in which a compartment is provided. The compartment within the housing 20 is filled with a pyrotechnic mixture 40 comprising a first constituent 45 and a second constituent 46. The well tool device 10 further comprises an ignition device 50. The first constituent 45 is a metal oxide and the second constituent 46 is a metal. The housing 20 may be made of steel, alternatively the housing 20 may be made of the second constituent 46.

The well tool device 10 may have a cylindrical shape, i.e. having a circular cross sectional shape perpendicular to the longitudinal axis I-I. It should be noted that the well tool device 10 alternately may have a triangular, square or even polygonal circular cross sectional shape.

The above well tool device 10 may be the prior art well tool device 110 described in the introduction above with reference to FIG. 1*a* and FIG. 1*b*. It should be noted that in FIG. 2, the housing 20 is indicated as a white rectangle, i.e. the content within the housing 20 is not indicated in FIG. 2.

However, in the present embodiment, the well tool device is not identical to the prior art well tool device, as is apparent from the description below.

In the present embodiment, the metal oxide is bismuth oxide, also referred to as bismuth(III) oxide or Bi2O3. In the present embodiment, the metal is aluminum Al or an aluminum alloy.

The pyrotechnic mixture 40 will, when ignited by the ignition device 50, start a heat generating exothermic reduction-oxidation process:

$$Bi_2O_3+2Al \rightarrow Al_2O_3+2Bi+heat$$

This type of pyrotechnic mixture 40 is often referred to as thermite, and the heat generating reaction is often referred to as a thermite reaction.

The heat will melt the surroundings at the location of the well tool device, such as casing, cement, and possibly also parts of the formation radially outside of the casing and cement. It should be noted that there may be two or more casings outside of each other. The annulus between the casings may be fluid-filled, filled with cement, gravel or other materials. After cooling, a cap-rock to cap-rock permanent barrier extending across the whole cross-section of a wellbore may be the result. Hence, the result may be similar to the result shown in FIG. 1*b*.

In a subsequent step, which is also shown in FIG. 2, a further amount of the first constituent 45 is lowered into the well. The further amount of the first constituent 45 is initially transported into the well by means of a container 60 suspended from a wireline 2. The container 60 is then opened, as indicated by an arrow in FIG. 2, which allows the further amount of the first constituent 45 to sink down to the well tool device 10, more specifically to the annulus radially outside of the well tool device 10 and inside of the inner casing IC. Such a container 60 is often referred to as a bailer, and the operation of using such a container is often referred to as a bailing operation.

In a next step, the first particulate constituent 45 is allowed to sink down and to settle as sediment at the desired location by waiting a first predetermined period of time TP1. This will be obtained by gravity, as the first constituent and the second constituent have a density higher than the density of the well fluid. The time period TP will be depending on setting depth, estimations of viscosities and particle size/shape and the type of well fluids. Experiments conducted with settlement in water is 3-5 seconds per meter of fluid, which corresponds to an approximate settling time at 1500 m depth of 1.5-2 hours. (more than one hour for each 1000 m).

In the present example, the second constituent 46 was lowered into the well as part of the well tool device 10. Hence, by the first constituent 45 lowered into the well in the housing 20 of the well tool device 10 and the container 60, and by the second constituent 46 lowered as part of (i.e. either as a particulates in the compartment of the housing 20 or as the material of the housing 20 itself) the well tool device 10, the entire inner diameter of the inner casing contains constituents of the pyrotechnic mixture 40.

The amounts of the first and second constituents are preferably determined and measured before the operation starts, to ensure that a stochiometric ratio between the first and second constituents are present in the well.

By allowing the allow the first, particulate constituent 45 to settle as sediment, the available space at the desired location may be filled entirely with the pyrotechnic mixture 40, causing the well fluid, typically water, to be displaced upwardly. Hence, a more efficient heat generating process may be achieved.

It should be noted that there may be alternative ways of lowering the further amount of the first constituent 45 into the well. In some wells it may be possible to lower the second constituent 45 from the topside of the well, i.e. to omit the use of the container 60.

It should also be noted that the it is possible that also the second constituent 46 is a particulate constituent 46. In such a case, the first constituent 45 and the second constituent 46 may be mixed before lowering them to the desired location. Due to the above period of time TP1, the second particulate constituent 46 is allowed to settle as sediment together with the first particulate constituent 45. It should be noted that due to different densities of the two constituents, the second constituent 46 and the first constituent 45 may settle in different layers.

Hence, in yet an alternative, it is possible to first lower a first amount of the first particulate constituent 45 and then wait the predetermined period of time TP1, then to lower a first amount of the second particulate constituent 46 and then wait a second predetermined period of time TP2. Then, a second amount of the first particulate constituent 45 is lowered and this amount is allowed to settle during a third period of time TP3 and then again a second amount of the second particulate constituent 46 are allowed to settle during a fourth period of time TP4. Hence, a layered or multilayered structure of the pyrotechnic mixture is achieved.

As used herein, the term "particulate" is referring to a material comprising a plurality of smaller particles. The particulate material may be in powder form or in a granule form. Typically, the particles have a size of 0.1 mm-5.0 mm.

EXAMPLE 2

Figure 3:
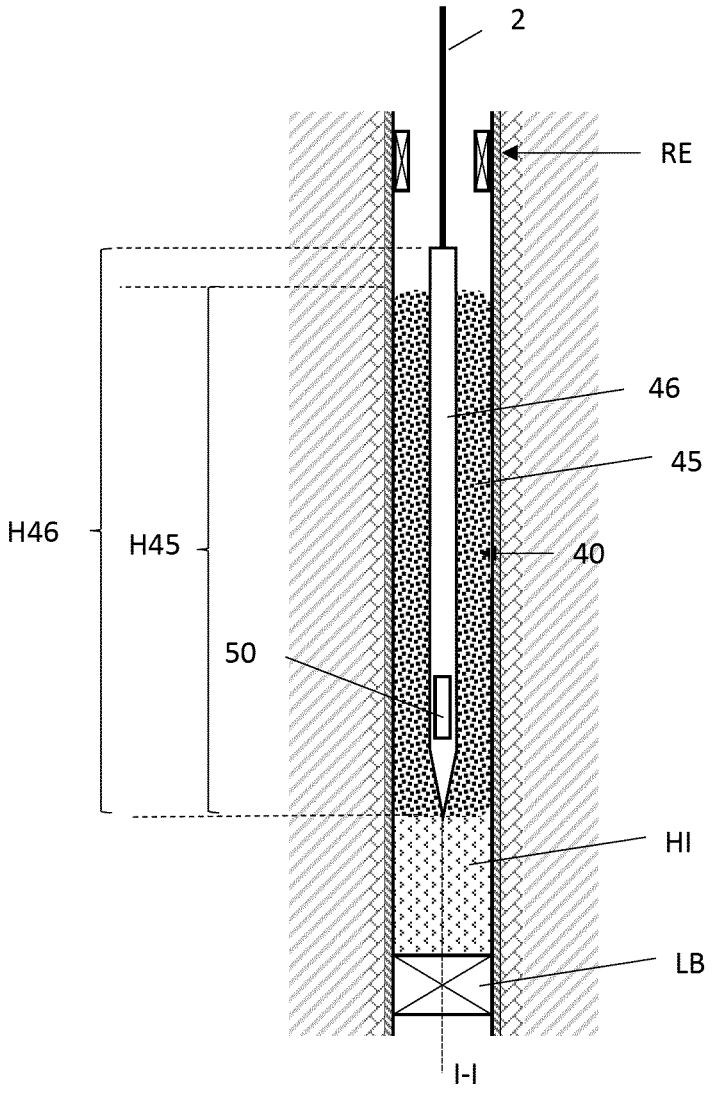
FIG. 3 illustrates a second embodiment in which a least one constituent of a pyrotechnic mixture provided outside a body made of a second constituent of the pyrotechnic mixture.

It is now referred to FIG. 3. Here it is shown that the well WE comprises a restriction RE, which is so narrow that the well tool device 10 in FIG. 2 cannot pass the restriction RE.

In a first step, the first particulate constituent 45 is lowered into the well, for example as described in example 1 above.

In a second step, the second constituent 46 in the form of a solid object, shown in FIG. 3 as a spear 46, is lowered into the first particulate constituent 45, where the pointed end of the spear will make it easier for the solid object to penetrate down into the first particulate constituent 45. As aluminum is a relatively light material, additional weight may be set on top of the spear to force it down. Alternatively, the spear may have a through bore, where a gas or liquid is flowing out from the end of the spear, thereby creating turbulence in the particulate metal oxide adjacent to the outer surface of the spear, making it easier to push or force the spear down. The outer diameter of the spear is less than the inner diameter of the restriction RE.

The ignition device 50 is here secured to the outside of, or provided in a compartment within, the spear.

Also here, the first particulate constituent 45 is allowed to sink down and to settle as sediment at the desired location by waiting a first predetermined period of time TP1.

In FIG. 3 it is shown that the height H45 of the level of the first constituent 45 is substantially equal to the height H46 of the spear 46.

In an alternative embodiment, the second constituent 46 in the form of the solid object is lowered first, and then the first particulate constituent 45 is lowered to the annulus outside of the solid object. Also here, the pointed end of the spear may be useful in order to pass the restriction. However, the pointed end is not a required, the object may be cylindrical.

In yet an alternative embodiment, the spear may comprise threads for rotating the spear down into the metal oxide. A rotation tool anchored to the inner casing above the spear is then needed.

EXAMPLE 3

Figure 4:
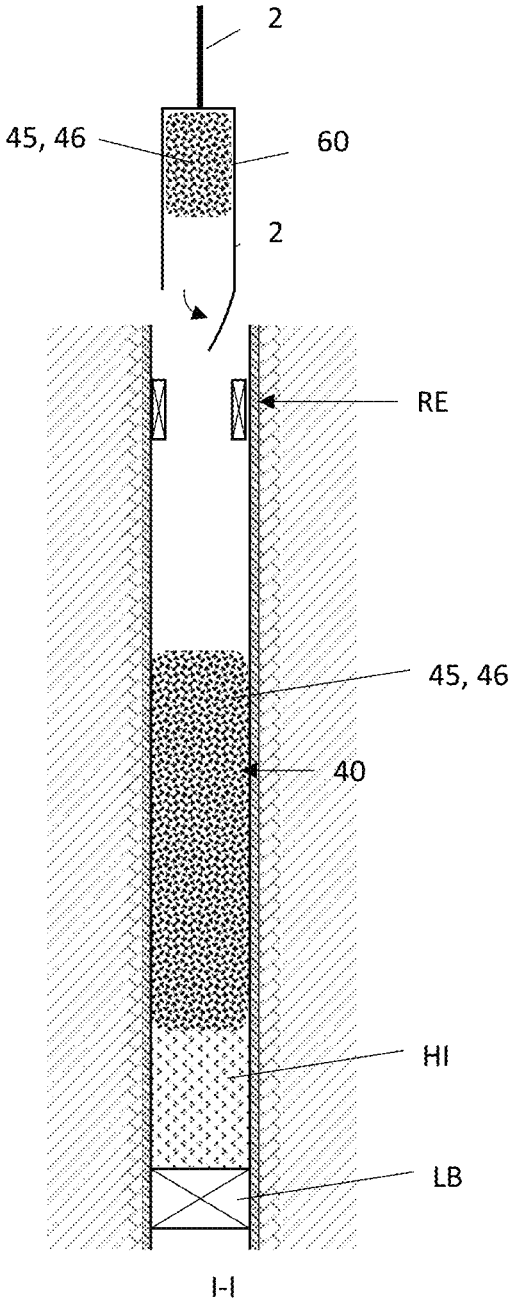
FIG. 4 illustrates the first constituent and the second constituent being lowered to the desired location as particles.

It is now referred to FIG. 4. Also here there is a restriction RE, making it difficult to use the well tool device 10. Here, both the first constituent 45 and the second constituent 46 are lowered to the desired location as particles.

As in one of the alternatives of the first example above, the first constituent 45 and the second constituent 46 may be mixed to a pyrotechnic mixture 40 topside and then lowered by means of the container 60 before the pyrotechnic mixture 40 is released from the container.

Alternatively, also mentioned as one of the alternatives of the first example above, the first constituent 45 and the second constituent 46 are lowered to the desired location alternatingly, allowing the constituents to settle as sediment before a new layer is added. Hence, also here, a layered or multilayered structure of the pyrotechnic mixture 40 is achieved.

It should be noted that example 3 may be used in wells WE without any restriction RE.

EXAMPLE 4

Figure 5:
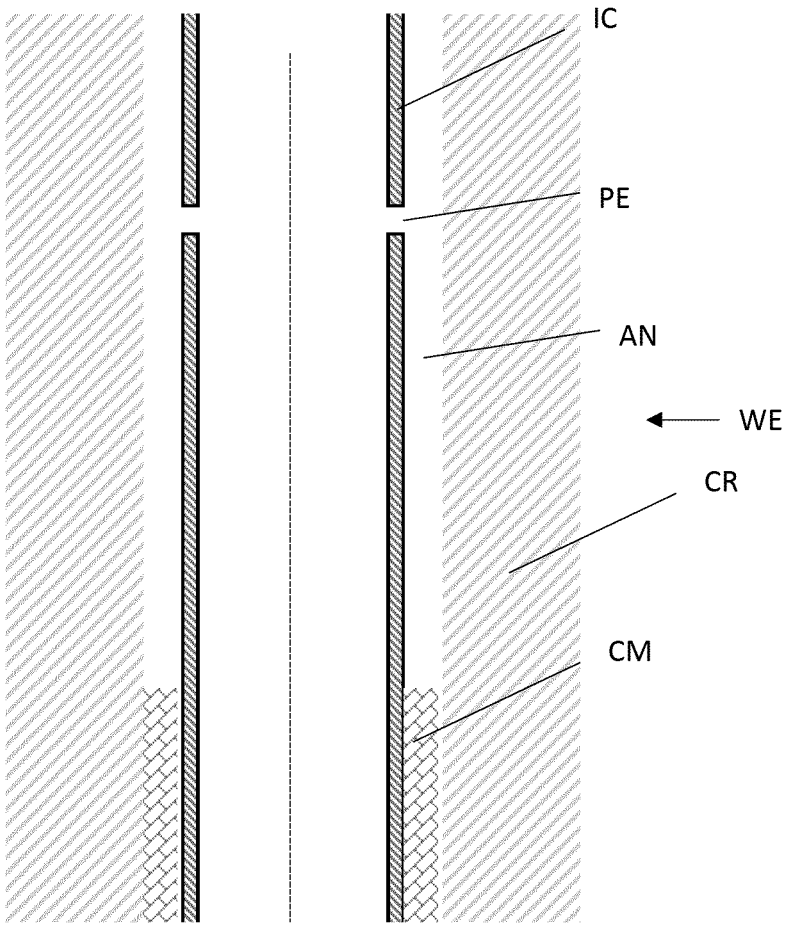
FIG. 5 illustrates a perforated inner casing of a well.

It is now referred to FIG. 5. Here it is shown an inner casing IC in which a part of the casing IC has been removed. The removed part of the inner casing IC is indicated as a perforation PE in FIG. 5. However, any method for removing a part of the casing can be used, for example milling, perforation, melting, eroding (for example by high pressure water with eroding particles), water jet cutting, mechanical punching, hydraulic punching, corrosion by acids etc.

The inner casing IC is partially cemented to the cap rock CR, as indicated by the cement CM. Above the cement CM, there is an annulus AN between the inner casing IC and the cap rock CR.

Figure 6:
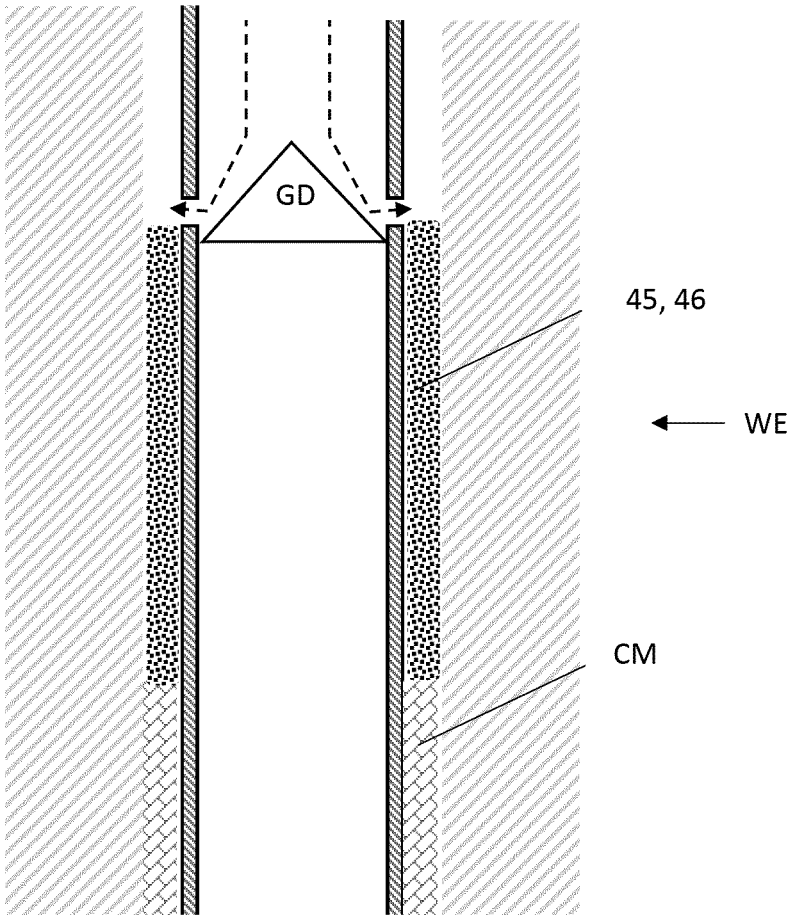
FIG. 6 illustrates how a first and/or second constituent of a pyrotechnic mixture is lowered to the space outside of the inner casing.

In FIG. 6 it is shown a guiding device GD lowered into the well. The guiding device GD comprises a guiding surface, for example a cone or similar, which are held stationary in the area below the removed part of the inner casing IC as shown in FIG. 6. Above the guiding device GD, a container (not shown in FIG. 6) similar to the container 60 of FIG. 4 is releasing the first constituent 45 and the second constituent 46, both constituents as particles. The particles are guided by the guiding device GD into the annulus AN via the removed part of the inner casing IC, where it will move down towards the cement CE due to gravity.

In addition to allow the first and second particles to settle as sediment, the particles may undergo a sintering process.

Figure 7:
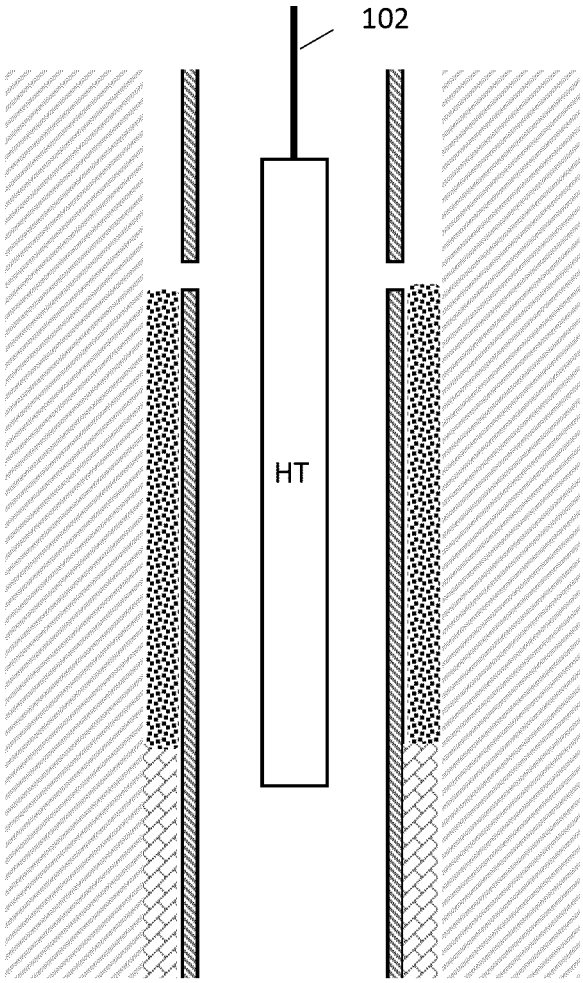
FIG. 7 illustrates a heater for sintering of the pyrotechnic mixture outside of the inner casing.

It is now referred to FIG. 7, where the guiding device GD has been removed and a heater HT has been lowered into the inner casing IC by wireline 102. Here, the first and second constituents are sintered by means of heat from the heating tool HT. The first and second constituents are heated to a temperature of ca 600-800° C., which is a temperature considerably lower than the temperature of ca. 1200° C. needed to initiate the thermite heat generation process.

The sintering process will prevent that the particulate constituent 45 and the second, particulate constituent 46 become unintentionally flushed out from the annulus again.

In an alternative to the above, it is possible that only one of the first constituent 45 and the second constituent 46 is be delivered to the annulus AN. Preferably, the first constituent 45 is delivered to the annulus AN.

Figure 8:
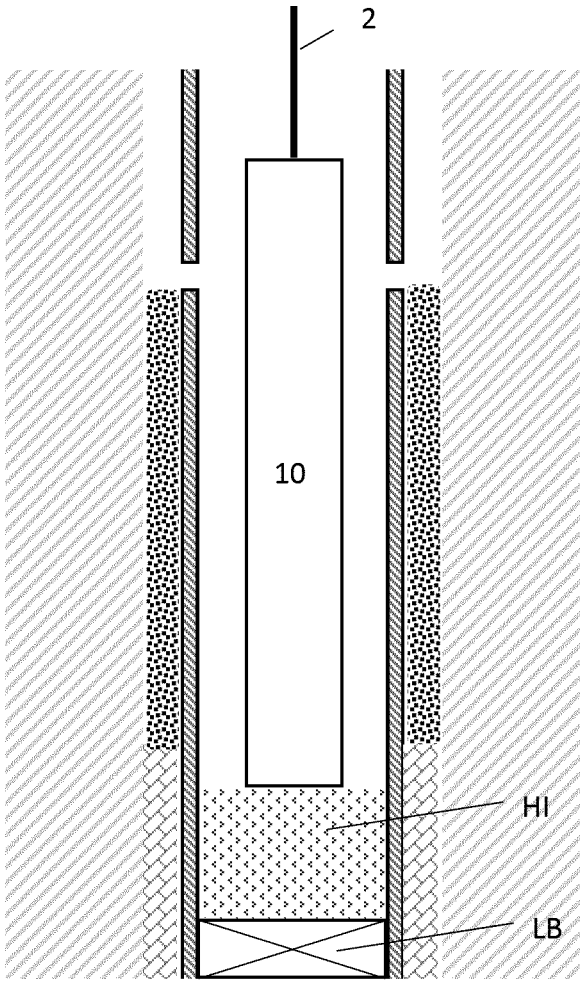
FIG. 8 illustrates a well tool device containing a pyrotechnic mixture lowered to the area of the perforations in the inner casing.

In FIG. 8, it is shown that the well tool device 10 is lowered inside the inner casing IC. The well tool device 10 may here comprise a desired amount of the first constituent 45 and the second constituent 46, taken the amount of the first and/or second constituent 45, 46 already present in the annulus AN into the consideration.

EXAMPLE 5

It should be noted that the annulus AN may be filled with the first constituent 45 already during the construction of the well. Here, the first constituent 45 is brought to the annulus outside predetermined sections of the casing, while cement is brought to the annulus outside other sections of the casing. Here, the step of removing a part of the casing (i.e. by perforation or other methods) is not necessary, as the annulus AN is available from the topside during the construction of the well. As an example, the first constituent 45 may be circulated to the desired location of the annulus, similar to how the cement is brought to the annulus.

The first constituent 45 to also here allowed to solidify in the annulus, thereby providing zonal isolation between the casing and the formation wall or between the casing and the further casing.

The first constituent 45 may also here be solidified by a sintering process by means of a heater or is allowed to solidify by allowing the first constituent 45 to settle as sediment.

It should be noted that during the production phase of the well, the first constituent 45 will not be considered to represent a danger with respect to unintentional ignition, as only small amounts of metal to react with is present and as the ignition temperature needed is very high.

The first constituent 45 will be present in the annulus AN until a plugging and abandonment operation is to be performed. Here, the second constituent 46 of the pyrotechnic mixture 40 is lowered to the area of the solidified first constituent 45, and the pyrotechnic mixture 40 is ignited to start the heat generating exothermic reduction-oxidation process.

Alternative Embodiments

Even though the examples and drawings above only show the well WE to comprise one casing, the same examples may be used for wells WE having two or more casings radially outside of each other. In some situations, there may be a need to seal of the annulus between two casings and/or between a casing and the formation. Sealing of an annulus between two casings and/or between a casing and a formation is known from for example WO2019112438 (in the name of CannSeal AS).

In the above examples, we have referred to the formation as a cap rock CR. It should be noted that the examples may be used for other formations in the well.

In the above examples, one alternative has been to mix the first constituent 45 with the second constituent 46 into a pyrotechnic mixture 40 topside, and then lower the pyrotechnic mixture 40 into the desired position. Due to the different densities of the first constituent 45 relative to the second constituent 46, it may be difficult to predict how the distribution of the respective constituents will be when the pyrotechnic mixture 40 has settled as sediment in the well WE.

Therefore, in one alternative embodiment, the first and second constituents 45, 46 are formed as a core-shell composition with alternating materials in the core and in the shell. The process of forming such a core-shell composition is described in Xia, Min et al. "Preparation of Bi2O3/Al Core-Shell Energetic Composite by Two-Step Ball Milling Method and Its Application in Solid Propellant." Materials (Basel, Switzerland) vol. 12, 11 1879. 11 Jun. 2019, doi: 10.3390/ma12111879.

It should be noted that the pyrotechnic mixture 40 may comprise other metal oxides and metals than the abovementioned bismuth oxide and aluminum. One alternative embodiment is iron oxide and aluminum, but there are various other metal oxides and metals.

It should be noted that the first and/or second constituents may be lowered into the well as a "dry" particles. However, the first and/or second constituents may also be mixed with a carrier liquid topside. The carrier liquid may make it easier to empty the container 90, by avoiding that some of the dry particles adheres to each other and to the inner surface of the container when lowered into the well.

The invention claimed is:

1. A method for providing a permanent barrier in a well having a well pipe, the method comprising:

lowering a first particulate constituent of a pyrotechnic mixture to a desired location in the well pipe or adjacent to the well pipe, wherein the first particulate constituent is a metal oxide;

waiting a first predetermined period of time for the first particulate constituent to settle as sediment at the desired location;

lowering a second constituent of the pyrotechnic mixture to the desired location, wherein the second constituent is a metal;

igniting the pyrotechnic mixture to start a heat generating exothermic reduction-oxidation process; and before the lowering of the first particulate constituent or before the igniting of the pyrotechnic mixture, lowering a heating tool into the well pipe to a location adjacent to the desired location, and sintering the first particulate constituent or the second particulate constituent by heat from the heating tool.

2. The method according to claim 1, wherein the lowering of the second constituent comprises:

lowering the second constituent as a second particulate constituent to the desired location; and waiting a second predetermined period of time for the second particulate constituent to settle as sediment.

3. The method according to claim 2, wherein the lowering of the first particulate constituent and the waiting of the first predetermined period of time are performed before the lowering of the second constituent as the second particulate constituent and the waiting of the second predetermined period of time.

4. The method according to claim 3, wherein the lowering of the first particulate constituent and the waiting of the first predetermined period of time, followed by the lowering of the second constituent as the second particulate constituent and the waiting of the second predetermined period of time, are repeated in an alternating manner so that a multi-layered sediment is formed at the desired location.

5. The method according to claim 1, wherein the lowering of the second constituent comprises:

lowering the second constituent as one or a plurality of solid objects to the desired location.

6. The method according to claim 1, wherein the lowering of the second constituent comprises:

lowering the second constituent of the pyrotechnic mixture into contact with the first particulate constituent at the desired location.

7. The method according to claim 1, further comprising:

prior to the lowering of the first particulate constituent, removing a portion of the well pipe of the well so as to form communication with an annulus outside of the well pipe, wherein the annulus forms the desired location.

8. The method according to claim 7, further comprising:

lowering a guide to an area in which the portion of the well pipe has been removed; and guiding the first particulate constituent or the second constituent to the desired location via the guide.

9. The method according to claim 1, wherein the first particulate constituent is a particulate matter having a particle size of 0.1 to 5.0 mm.

10. The method according to claim 1, wherein the first particulate constituent comprises bismuth oxide ($Bi_2O_3$).

11. The method according to claim 1, wherein the second constituent comprises aluminum or an aluminum alloy.

* * * * *